US006102451A

United States Patent [19]

Merryman

[11] Patent Number: 6,102,451

[45] Date of Patent: Aug. 15, 2000

[54] DOOR LATCH PUSH BAR ASSEMBLY

[76] Inventor: Donald E. Merryman, 104 Woodland Rd., Millville, N.J. 08332

[21] Appl. No.: 09/282,936

[22] Filed: Apr. 1, 1999

[51] Int. Cl.[7] ..... E05B 65/10

[52] U.S. Cl. ..... 292/92; 292/336.3; 292/352; 292/DIG. 2; 292/DIG. 54

[58] Field of Search ..... 292/92, 93, DIG. 2, 292/DIG. 53, DIG. 54, DIG. 65, 336.3, 347, 352

[56] References Cited

U.S. PATENT DOCUMENTS

| | | | |
|---|---|---|---|
| 975,456 | 11/1910 | Prevost | 292/93 |
| 1,007,306 | 10/1911 | Nevins et al. | 292/93 |
| 1,386,551 | 8/1921 | Bumbarger | 292/92 |
| 2,104,618 | 1/1938 | Hasenfuss | 292/93 |
| 2,871,050 | 1/1959 | Dickinson | 292/92 |
| 2,980,459 | 4/1961 | Schwanz et al. | 292/92 |
| 3,025,095 | 3/1962 | Christensen | 292/92 |
| 4,181,335 | 1/1980 | Thoren | 292/92 |
| 5,713,614 | 2/1998 | Anderson | 292/336.3 |
| 5,769,145 | 6/1998 | Kwatonowski | 160/371 |

*Primary Examiner*—B. Dayoan
*Assistant Examiner*—Clifford B Vaterlaus

[57] ABSTRACT

A door latch push bar assembly for providing a push bar for unlatching a door latch such as the type found on storm doors. The door latch push bar assembly includes a mounting bracket and an elongate rod having a pair of opposite ends. A first of the ends of the rod is pivotally coupled to the mounting bracket. The mounting bracket is designed for mounting to a door adjacent a first side of the door. A second of the ends of the rod is designed for extending towards a second side of the door and for receiving a free end of pivotable lever of a latch adjacent the second side of the door releasably engaging the second side of the door to an adjacent portion of a door frame.

4 Claims, 2 Drawing Sheets

DOOR LATCH PUSH BAR ASSEMBLY

BACKGROUND OF THE INVENTION

1. Field of the Invention

The present invention relates to latch push bar assemblies for storm doors and more particularly pertains to a new door latch push bar assembly for providing a push bar for unlatching a door latch such as the type found on storm doors.

2. Description of the Prior Art

The use of latch push bar assemblies for storm doors is known in the prior art. More specifically, latch push bar assemblies for storm doors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,181,335; 3,025,095; 2,980,459; 2,871,050; 5,340,171; and U.S. Pat. No. Des. 268,003.

While these devices fulfill their respective, particular objectives and requirements, the aforementioned patents do not disclose a new door latch push bar assembly. The inventive device includes a mounting bracket and an elongate rod having a pair of opposite ends. A first of the ends of the rod is pivotally coupled to the mounting bracket. The mounting bracket is designed for mounting to a door adjacent a first side of the door. A second of the ends of the rod is designed for extending towards a second side of the door and for receiving a free end of pivotable lever of a latch adjacent the second side of the door releasably engaging the second side of the door to an adjacent portion of a door frame.

In these respects, the door latch push bar assembly according to the present invention substantially departs from the conventional concepts and designs of the prior art, and in so doing provides an apparatus primarily developed for the purpose of providing a push bar for unlatching a door latch such as the type found on storm doors.

SUMMARY OF THE INVENTION

In view of the foregoing disadvantages inherent in the known types of latch push bar assemblies for storm doors now present in the prior art, the present invention provides a new door latch push bar assembly construction wherein the same can be utilized for providing a push bar for unlatching a door latch such as the type found on storm doors.

The general purpose of the present invention, which will be described subsequently in greater detail, is to provide a new door latch push bar assembly apparatus and method which has many of the advantages of the latch push bar assemblies for storm doors mentioned heretofore and many novel features that result in a new door latch push bar assembly which is not anticipated, rendered obvious, suggested, or even implied by any of the prior art latch push bar assemblies for storm doors, either alone or in any combination thereof.

To attain this, the present invention generally comprises a mounting bracket and an elongate rod having a pair of opposite ends. A first of the ends of the rod is pivotally coupled to the mounting bracket. The mounting bracket is designed for mounting to a door adjacent a first side of the door. A second of the ends of the rod is designed for extending towards a second side of the door and for receiving a free end of pivotable lever of a latch adjacent the second side of the door releasably engaging the second side of the door to an adjacent portion of a door frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new door latch push bar assembly apparatus and method which has many of the advantages of the latch push bar assemblies for storm doors mentioned heretofore and many novel features that result in a new door latch push bar assembly which is not anticipated, rendered obvious, suggested, or even implied by any of the prior art latch push bar assemblies for storm doors, either alone or in any combination thereof.

It is another object of the present invention to provide a new door latch push bar assembly which may be easily and efficiently manufactured and marketed.

It is a further object of the present invention to provide a new door latch push bar assembly which is of a durable and reliable construction.

An even further object of the present invention is to provide a new door latch push bar assembly which is susceptible of a low cost of manufacture with regard to both materials and labor, and which accordingly is then susceptible of low prices of sale to the consuming public, thereby making such door latch push bar assembly economically available to the buying public.

Still yet another object of the present invention is to provide a new door latch push bar assembly which provides in the apparatuses and methods of the prior art some of the advantages thereof, while simultaneously overcoming some of the disadvantages normally associated therewith.

Still another object of the present invention is to provide a new door latch push bar assembly for providing a push bar for unlatching a door latch such as the type found on storm doors.

Yet another object of the present invention is to provide a new door latch push bar assembly which includes a mounting bracket and an elongate rod having a pair of opposite ends. A first of the ends of the rod is pivotally coupled to the mounting bracket. The mounting bracket is designed for mounting to a door adjacent a first side of the door. A second of the ends of the rod is designed for extending towards a second side of the door and for receiving a free end of pivotable lever of a latch adjacent the second side of the door releasably engaging the second side of the door to an adjacent portion of a door frame.

Still yet another object of the present invention is to provide a new door latch push bar assembly that provides a hands-free means for releasing a latch on a storm door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
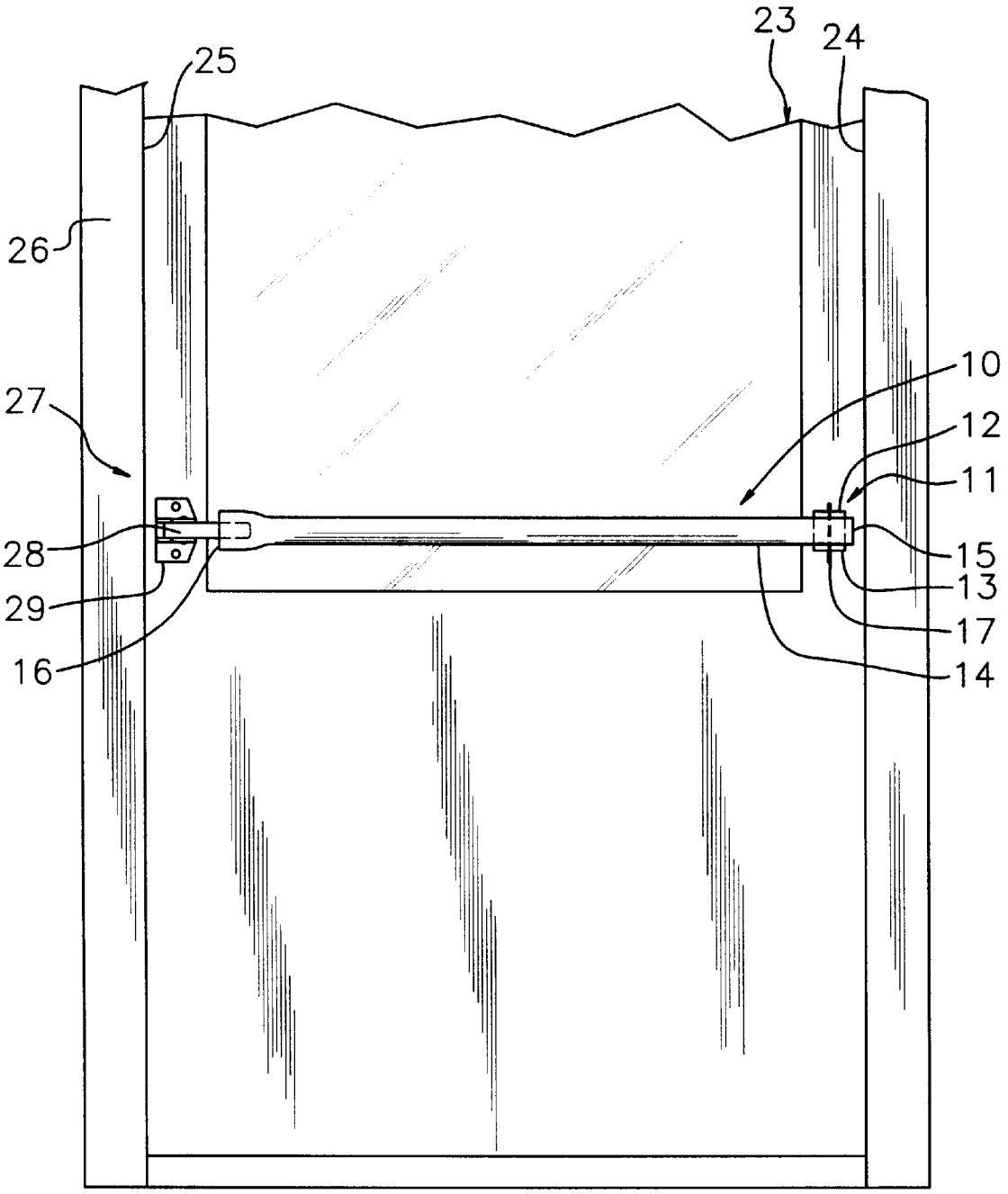
FIG. 1 is a schematic front view of a new door latch push bar assembly in use on a door according to the present invention.
Figure 2:
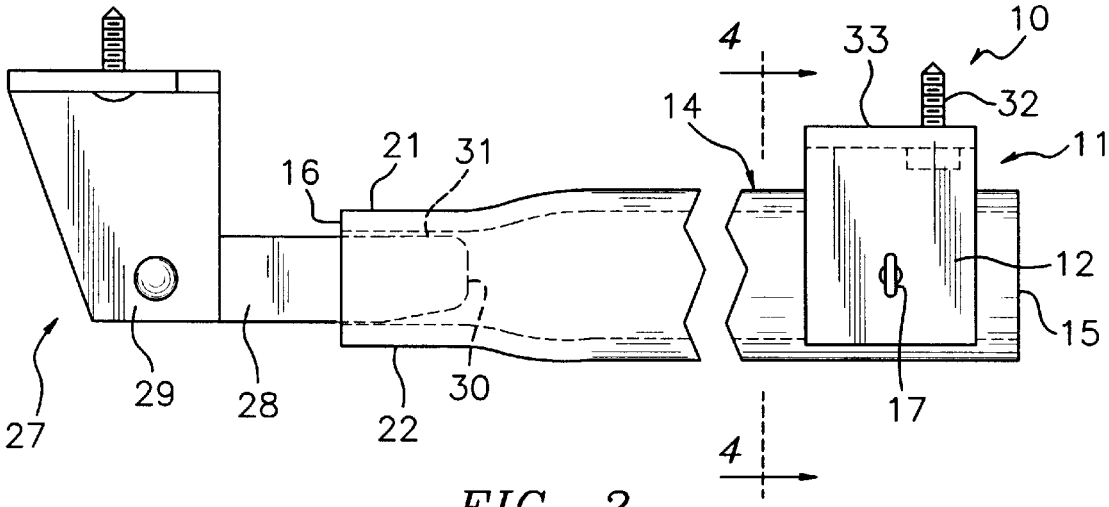
FIG. 2 is a schematic top view of the present invention.
Figure 3:
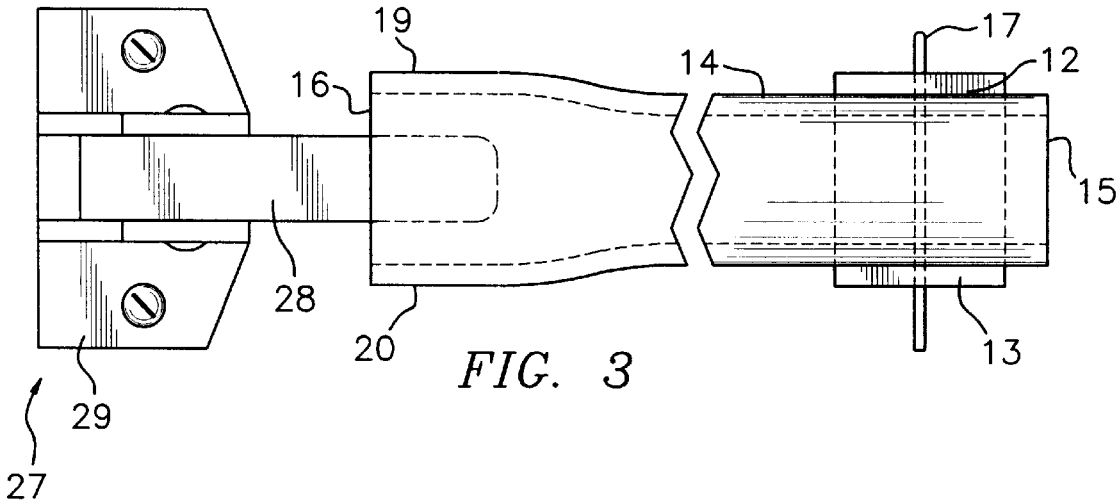
FIG. 3 is a schematic front view of the present invention.

With reference now to the drawings, and in particular to FIGS. 1 through 5 thereof, a new door latch push bar assembly embodying the principles and concepts of the present invention and generally designated by the reference numeral 10 will be described.

As best illustrated in FIGS. 1 through 5, the door latch push bar assembly 10 generally comprises a mounting bracket and an elongate rod having a pair of opposite ends. A first of the ends of the rod is pivotally coupled to the mounting bracket. The mounting bracket is designed for mounting to a door adjacent a first side of the door. A second of the ends of the rod is designed for extending towards a second side of the door and for receiving a free end of pivotable lever of a latch adjacent the second side of the door releasably engaging the second side of the door to an adjacent portion of a door frame.

In closer detail, the door latch push bar assembly 10 comprises a generally rectangular-U-shaped mounting bracket 11 having spaced apart and generally rectangular upper and lower arms 12,13 and a generally rectangular back portion 33 connecting the upper and lower arms together. The upper and lower arms of the mounting bracket are preferably extended substantially parallel to one another and substantially perpendicular to the back portion of the mounting bracket.

Figure 4:
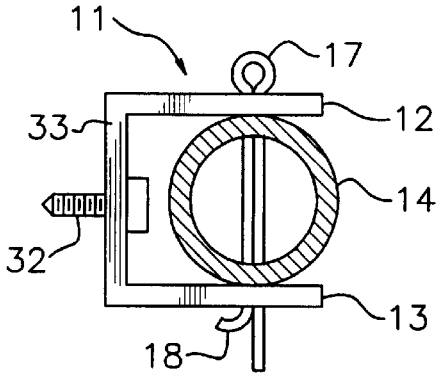
FIG. 4 is a schematic cross sectional view of the present invention taken from line 4—4 of FIG. 2.

A tubular elongate rod 14 is also provided having a pair of opposite open ends 15,16 and a longitudinal axis extending between the ends of the rod. The rod preferably has a generally circular transverse cross section taken substantially perpendicular to the longitudinal axis of the rod as best illustrated in FIG. 4.

A first of the ends 15 of the rod is extended between the upper and lower arms of the mounting bracket. An elongate pivot pin 17 is extended through coaxial holes in the upper and lower arms of the mounting bracket and corresponding coaxial holes in the first end of the rod to pivotally couple the first end of the rod to the upper and lower arms of the mounting arm to permit pivoting of the rod with respect to the mounting bracket about the pivot pin. Ideally, the pivot pin comprises a cotter pin with a bent end 18 extending from the lower arm of the mounting bracket to secure the cotter pin to the mounting bracket.

Figure 5:
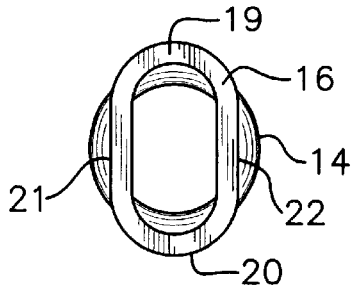
FIG. 5 is a schematic end view of the second end of the rod of the present invention.

A second of the ends 16 of the rod is preferably pinched or swaged to form top and bottom flared regions 19,20 and a pair of side regions 21,22 extending between the top and bottom flared regions. As best illustrated in FIG. 5, the second end of the rod has a generally oval transverse cross section taken substantially perpendicular to the longitudinal axis of the rod.

The rod has an outer diameter defined substantially perpendicular to the longitudinal axis of the rod. The second end of the rod has a length defined between the top and bottom flared regions and substantially perpendicular to the longitudinal axis of the rod, and a width defined between the side regions and substantially perpendicular to the longitudinal axis of the rod and to the length of the second end. The length of the second end of the rod is greater than the outer diameter of the rod and the width of the second end of the rod is less than the outer diameter of the rod.

As best illustrated in FIG. 1, the assembly 10 is designed for use with a door 23 such as a storm door having a pair of generally vertical sides 24,25. A first of the sides 24 of the door is pivotally coupled to one side of a door frame 26 around the door. The door has a latch 27 adjacent a second of the sides 25 of the door releasably engaging another side of the door frame to releasably hold the second side of the door to the other side of the door frame.

The latch has a pivotable release lever 28 pivotally mounted to the door by a pivot bracket 29 so that the lever outwardly extending from the door. The lever has a free end 30 extending towards the first side of the door. Commonly, the lever has a bend 31 adjacent the free end of the lever such that free end of the lever extends slightly towards the door. In use, pivoting of the free end of the lever towards the door disengages the latch from the another side of the door frame to release the second side of the door from the other side of the door frame.

The back portion of the mounting bracket is mounted to the door adjacent the first side of the door such that the upper and lower portions of the mounting bracket lie in generally horizontal planes and the longitudinal axis of the rod is generally horizontal, the rod is pivotable about a vertical axis at the pivot pin which is generally vertical. Preferably, a threaded fastener 32 is extended through a hole in the back portion of the mounting bracket into the door to mount the back portion of the mounting bracket to the door.

The second end of the rod is extended towards the second side of the door. The free end of the lever is inserted into the second end of the rod preferably to a depth where the bend of the lever is also inserted into the second end of the rod. The side regions of the rod may be further pinched towards one another such that the free end of the lever is loosely held in the second end of the rod between the side regions of the rod.

In use pivoting the rod about the pivot point in a direction towards the door moves the second end of the rod towards the door whereby the free end of the lever is also pivoted towards the door to disengage the latch from the other side of the door frame. This can be accomplished by a user leaning a portion of their body such as their hip against the rod to pivot the rod inwards and thereby release the latch without the need for the user to use their hands.

In an ideal illustrative embodiment, the outer diameter of the rod is about 1 inch, the length of the rod defined between the ends of the rod is about 28⅞ inches. In this ideal embodiment, the length of the second end of the rod is about 1½ inches. Also ideally, between about ⅜ inch to about ½ inch from the free end of the lever is inserted into the second end of the rod.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door latch push bar assembly, comprising:

a mounting bracket;

an elongate rod having opposite ends and a longitudinal axis extending between said ends of said rod;

a first of said ends of said rod being pivotally coupled to said mounting bracket;

said mounting bracket being adapted for mounting to a door adjacent a first side of the door;

a second of said ends of said rod being adapted for extending towards a second side of the door and for receiving a free end of a pivotable lever of a latch adjacent the second side of the door releasably engaging the second side of the door to an adjacent portion of a door frame;

wherein said mounting bracket has spaced apart upper and lower arms and a back portion connecting said upper and lower arms together, wherein said first end of said rod being extended between said upper and lower arms of said mounting bracket;

wherein an elongate pivot pin is extended through said upper and lower arms of said mounting bracket and said first end of said rod to pivotally couple said first end of said rod to said upper and lower arms of said mounting bracket; and wherein said pivot pin is coplanar with a pivot point of the pivotable lever of the latch such that said longitudinal axis of said rod is substantially co planar with said pivot pin of said mounting bracket and the pivot point of the pivotable lever of the latch for keeping said rod substantially parallel with the door and preventing said rod from extending beyond the latch.

2. The door latch push bar assembly of claim 1, wherein said pivot pin comprises a cotter pin.

3. The door latch push bar assembly of claim 1, wherein said second end of said rod is pinched to form top and bottom flared regions and a pair of side regions extending between said top and bottom flared regions such that said second end of said rod has a generally oval transverse cross section taken substantially perpendicular to said longitudinal axis of said rod.

4. A door latch push bar assembly, comprising:

a generally rectangular-U-shaped mounting bracket having spaced apart and generally rectangular upper and lower arms and a generally rectangular back portion connecting said upper and lower arms together;

said upper and lower arms of said mounting bracket being extended substantially parallel to one another and substantially perpendicular to said back portion of said mounting bracket;

a tubular elongate rod having opposite open ends and a longitudinal axis extending between said ends of said rod;

said rod having a generally circular transverse cross section taken substantially perpendicular to said longitudinal axis of said rod;

a first of said ends of said rod being extending between said upper and lower arms of said mounting bracket;

an elongate pivot pin being extended through coaxial holes in said upper and lower arms of said mounting bracket and corresponding coaxial holes in said first end of said rod to pivotally couple said first end of said rod to said upper and lower arms of said mounting arm to permit pivoting of said rod with respect to said mounting bracket about said pivot pin;

wherein said pivot pin comprises a cotter pin having a bent end extending from said lower arm of said mounting bracket to secure said cotter pin to said mounting bracket;

a second of said ends of said rod being pinched to form top and bottom flared regions and a pair of side regions extending between said top and bottom flared regions;

said second end of said rod having a generally oval transverse cross section taken substantially perpendicular to said longitudinal axis of said rod;

said rod having an outer diameter defined substantially perpendicular to said longitudinal axis of said rod;

said second end of said rod having a length defined between said top and bottom flared regions and substantially perpendicular to said longitudinal axis of said rod, and a width defined between said side regions and substantially perpendicular to said longitudinal axis of said rod and to said length of said second end;

wherein said length of said second end of said rod is greater than said outer diameter of said rod and said width of said second end of said rod is less than said outer diameter of said rod;

a door having a pair of sides, a first of said sides of said door being pivotally coupled to one side of a door frame around said door;

said door having a latch adjacent a second of said sides of said door releasably engaging another side of said door frame to releasably hold said second side of said door to said other side of said door frame;

said latch having a pivotable lever outwardly extending from said door, said lever having a free end extending towards said first side of said door;

wherein said lever has a bend adjacent said free end of said lever such that free end of said lever extends towards said door;

wherein pivoting of said free end of said lever towards said door disengages said latch from said another side of said door frame to release said second side of said door from said other side of said door frame;

said back portion of said mounting bracket being mounted to said door adjacent said first side of said door such that said upper and lower arms of said mounting bracket lie in generally horizontal planes and said longitudinal axis of said rod is generally horizontal, said rod being pivotable about a vertical axis of said pivot pin;

wherein a threaded fastener is extended through said back portion of said mounting bracket into said door to mount said back portion of said mounting bracket to said door;

said second end of said rod being extended towards said second side of said door; and said free end of said lever being inserted into said second end of said rod to a depth where said bend of said lever is also inserted in to said second end of said rod;

said side regions of said rod being further pinched towards one another such that said free end of said lever is loosely held in said second end of said rod between said side regions of said rod;

wherein pivoting of said rod about said pivot pin in a direction towards the door moves said second end of said rod towards the door whereby said free end of said lever is also pivoted towards the door to disengage the latch from the other side of the door frame;

wherein said outer diameter of said rod is about 1 inch, said length of said rod defined between said ends of said rod being about 28 and ⅞ inches;

wherein said length of said second end of said rod is about 1 and ½ inches;

wherein between about ⅜ inch to about ½ inch of said free end of said lever is inserted into said second end of said rod; and wherein said pivot pin is coplanar with a pivot point of the pivotable lever of the latch such that said longitudinal axis of said rod is substantially co planar with said pivot pin of said mounting bracket and the pivot point of the pivotable lever of the latch for keeping said rod substantially parallel with the door and preventing said rod from extending beyond the latch.

* * * * *